US006024361A

United States Patent [19]

Assoumou

[11] Patent Number: 6,024,361

[45] Date of Patent: Feb. 15, 2000

[54] KWANZA BOARD GAME

[76] Inventor: Ngoran Assoumou, 11213 Lake Overlook Pl., Mitchellville, Md. 20721

[21] Appl. No.: 09/099,370

[22] Filed: Jun. 18, 1998

[51] Int. Cl.[7] ..... A63F 3/02

[52] U.S. Cl. ..... 273/264; 272/242

[58] Field of Search ..... 273/242, 264, 273/263, 267, 271

[56] References Cited

U.S. PATENT DOCUMENTS

| | | | |
|---|---|---|---|
| D. 52,784 | 12/1918 | Creifelds | 273/264 X |
| D. 146,060 | 12/1946 | Muncheryan | 273/264 X |
| 1,499,214 | 6/1924 | Griebel | 273/264 |
| 1,529,132 | 3/1925 | Jimison | 273/264 |
| 3,190,655 | 6/1965 | Louie | 273/264 |
| 4,063,734 | 12/1977 | Taylor | 273/264 |
| 4,579,347 | 4/1986 | Reman | 273/264 |
| 4,852,887 | 8/1989 | Li | 273/264 |
| 5,429,370 | 7/1995 | Binder | 273/264 |

*Primary Examiner*—Sam Rimell
*Attorney, Agent, or Firm*—Henderson & Sturm LLP

[57] ABSTRACT

A board game 10 for familiarizing the players with the concept of strategy, as well as educating the players with respect to typical African culture and tradition. The game board 10 has three concentrically arranged game squares 21, 22, 23, connected to one another by a plurality of connecting lines 24, 25, 26, and 27 and provided with a plurality of pictorial squares 30 representative of the broad spectrum of African traditions and culture.

11 Claims, 5 Drawing Sheets

KWANZA BOARD GAME

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of board games in general, and in particular to a board game that focuses on African culture and tradition.

2. Description of Related Art

As most people are universally aware, there are numerous patented board games covering myriad and diverse topics, subjects, and themes.

While all of the aforementioned prior art constructions are more than adequate for the basic purpose and function for which they have been specifically designed, they are uniformly deficient with respect to their failure to provide a board game that is specifically focused on African culture and tradition to assist African Americans in gaining a better understanding of their historical roots and the culture and traditions that have existed for centuries in their ancestral homeland.

To date, no one has developed such a game board that not only requires strategy to play the game, but also serves an educational purpose in familiarizing the players with African culture and tradition.

As a consequence of the foregoing situation, there has existed a longstanding need for a new and improved board game for educating African Americans regarding their ancestral culture and traditions and which also employs the same basic strategy that is used in a traditional African game using sticks and a plot of bare ground, and the provision of such a board game is the stated objective of the present invention.

BRIEF SUMMARY OF THE INVENTION

Briefly stated, the board game that forms the basis of the present invention is loosely based on a traditional West African game which is played with a plurality of sticks and a pattern of interconnected squares that is scratched into a bare patch of soil. The sticks are selectively forced into penetrating engagement with the ground at the corners and midpoints of the sides of each square to indicate the position of the game pieces.

As will be explained in greater detail further on in the specification, in the game board version of this traditional African game, pictorial squares are disposed at the corners and midpoints of each of the three interconnected game squares, and the pictorial representations on each game square are arranged in a specific pattern to represent different aspects of African tradition and culture.

For instance, different groups of related pictorial squares represent different themes on each of the game squares such as the theme of religion, which includes, mysticism, spiritualism, and animist beliefs, other groups of related pictorial squares represents the theme of the African environment and still further groups of related pictorial represents the theme of squares the African social culture.

Furthermore, while the game board is patterned on a traditional African game, the presence and orientation of the pictorial squares tells a story and raises the consciousness and awareness of African Americans regarding their ancestral African culture and traditions.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
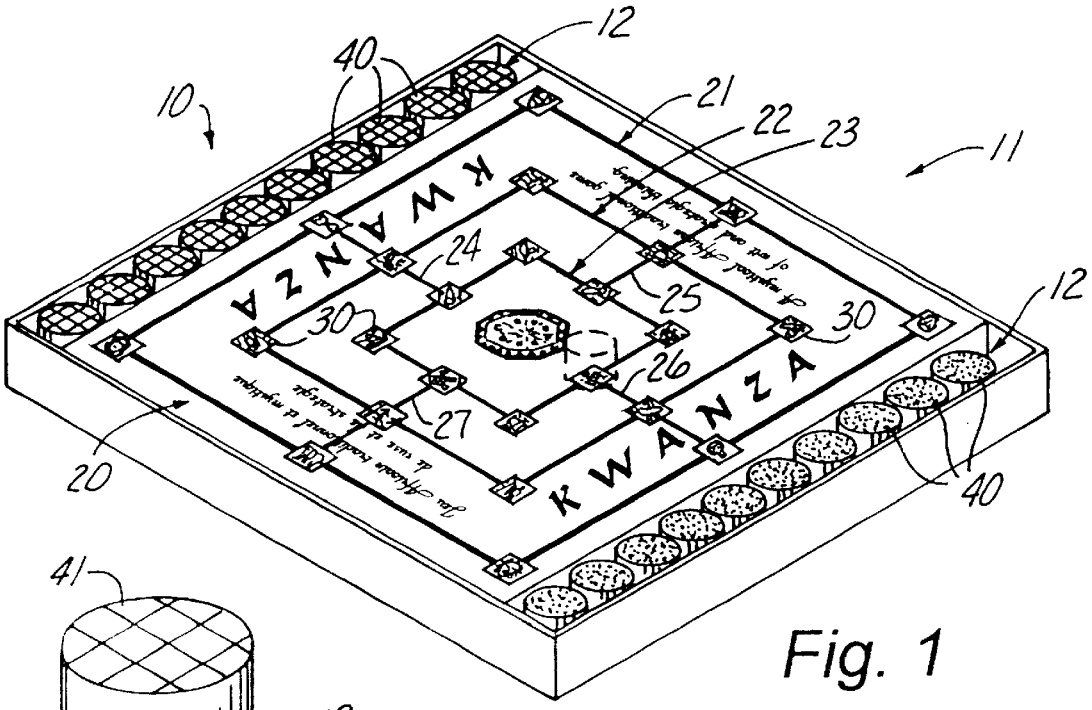
FIG. 1 is a perspective view of the game board and playing pieces that comprise the basis of the present invention.

As can be seen by reference to the drawings, and in particularly to FIG. 1, the Kwanza board game that forms the basis of the present invention is designated generally by the reference number 10. The board game 10 comprises in general, a game board unit 11, and game piece units 12. These units will now be described in seriatim fashion.

Figure 3:
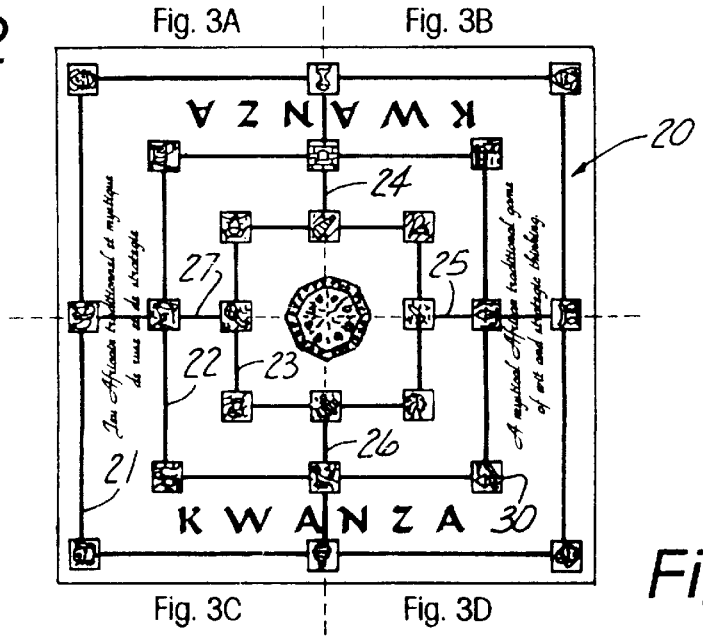
FIG. 3 is top plan view of the board.
Figure 3A:
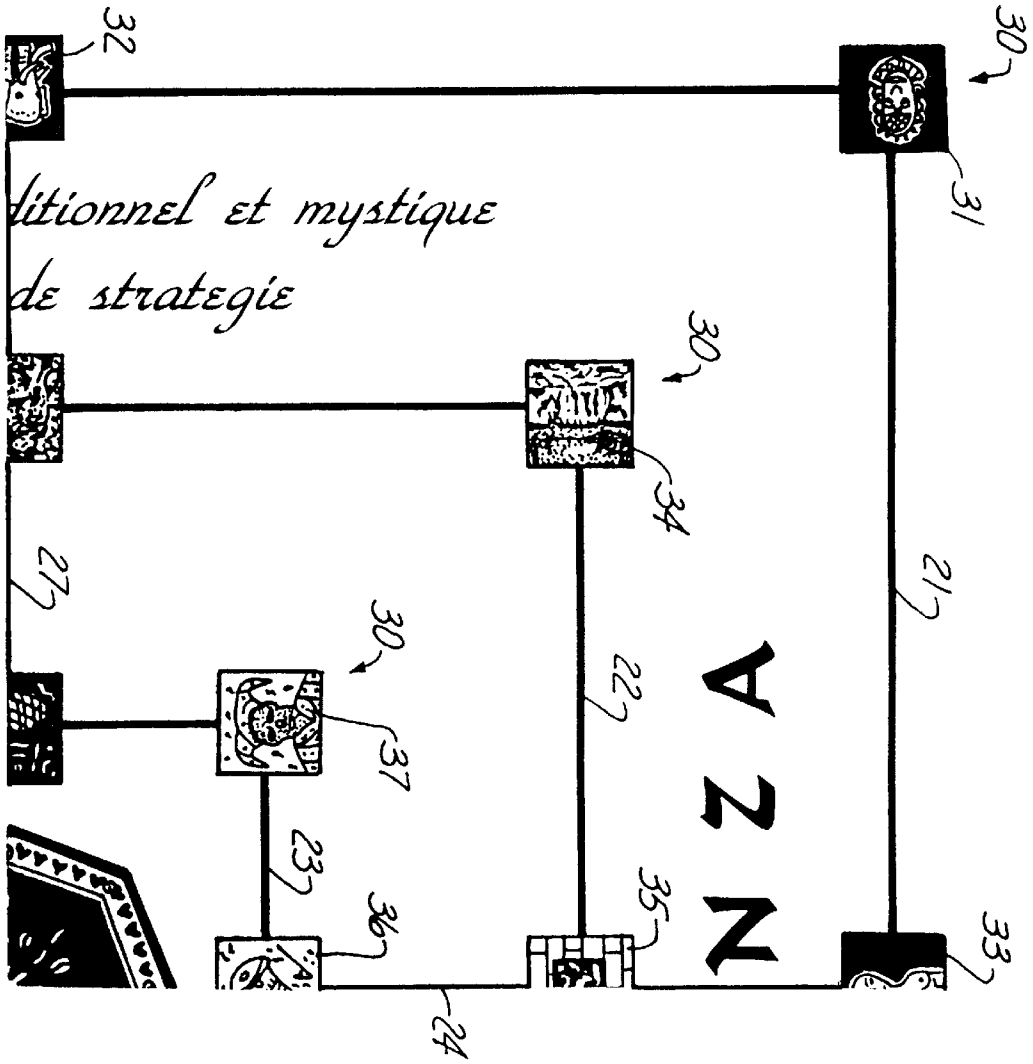
FIGS. 3A, 3B, 3C and 3D are enlarged detail views of the corresponding labeled quadrants of the game board depicted in FIG. 3.
Figure 3B:
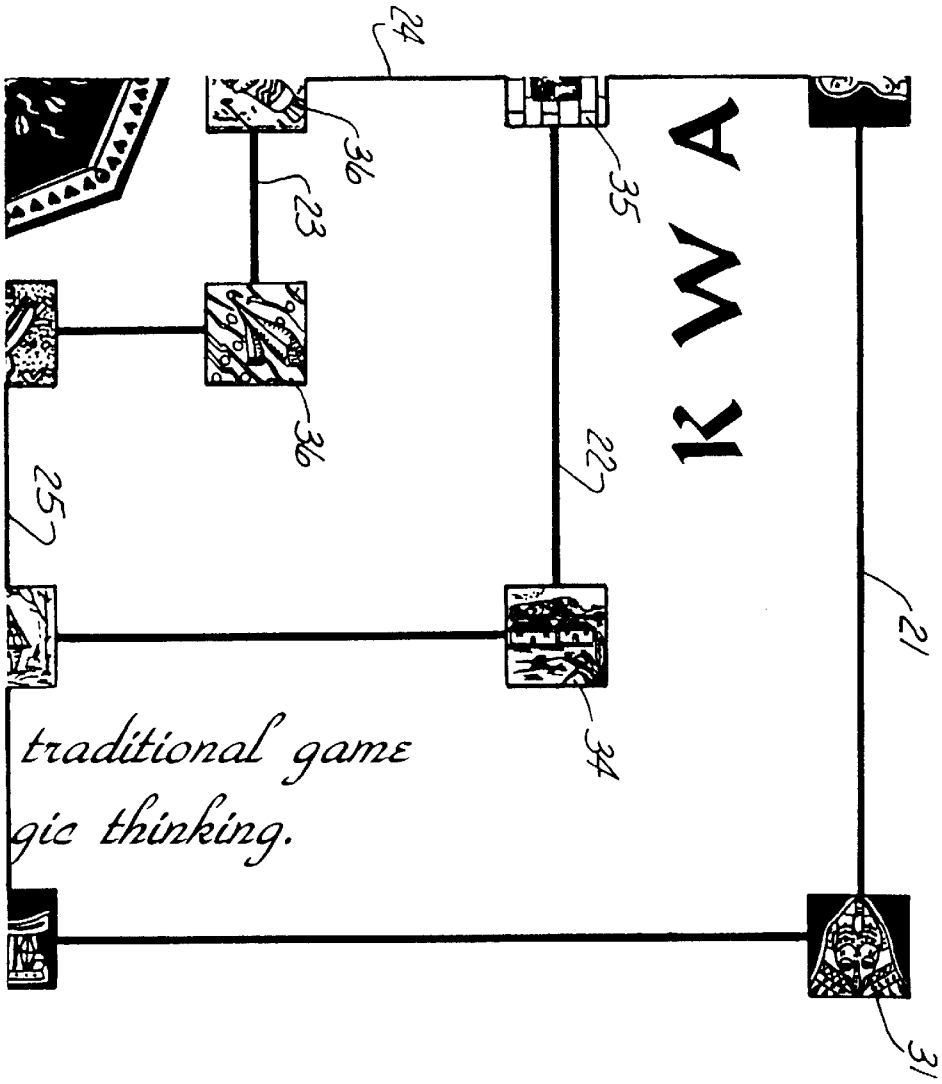
Figure 3C:
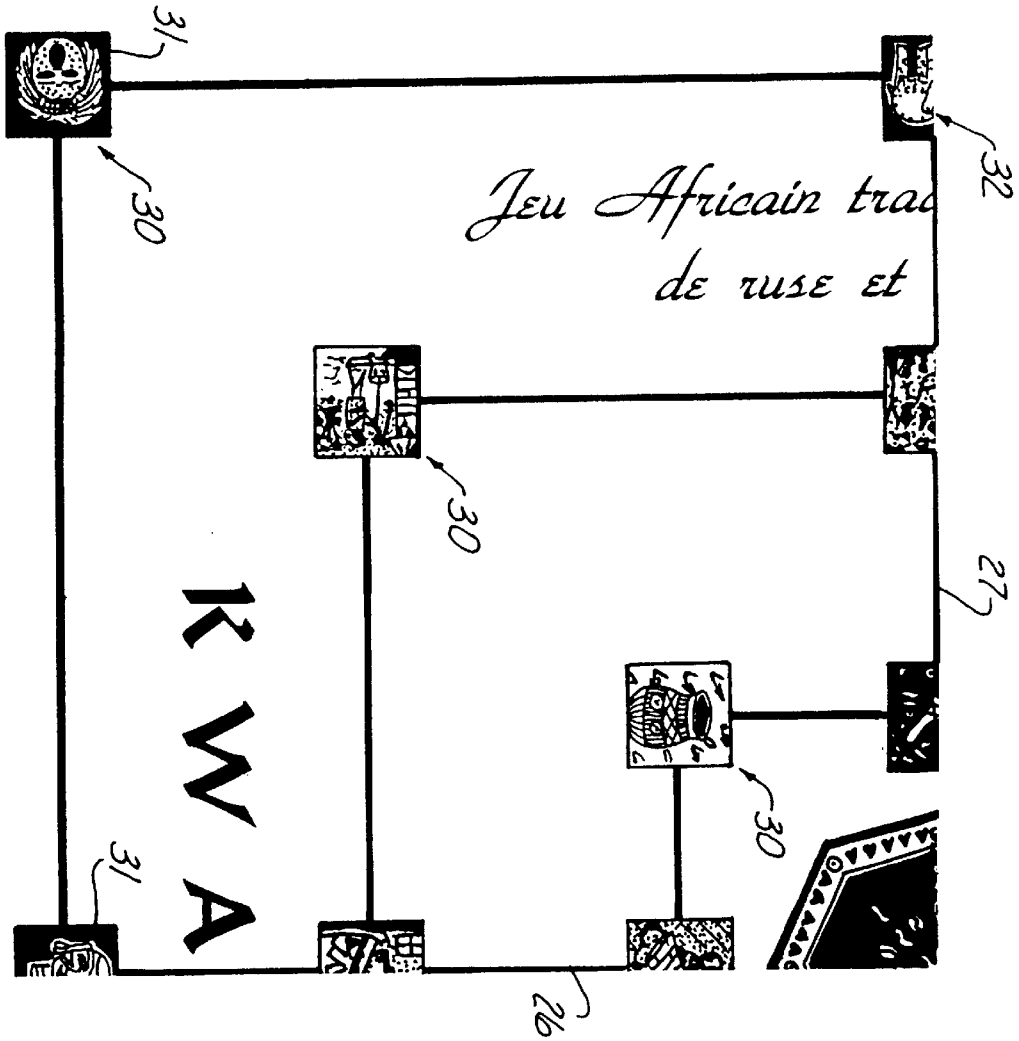
Figure 3D:
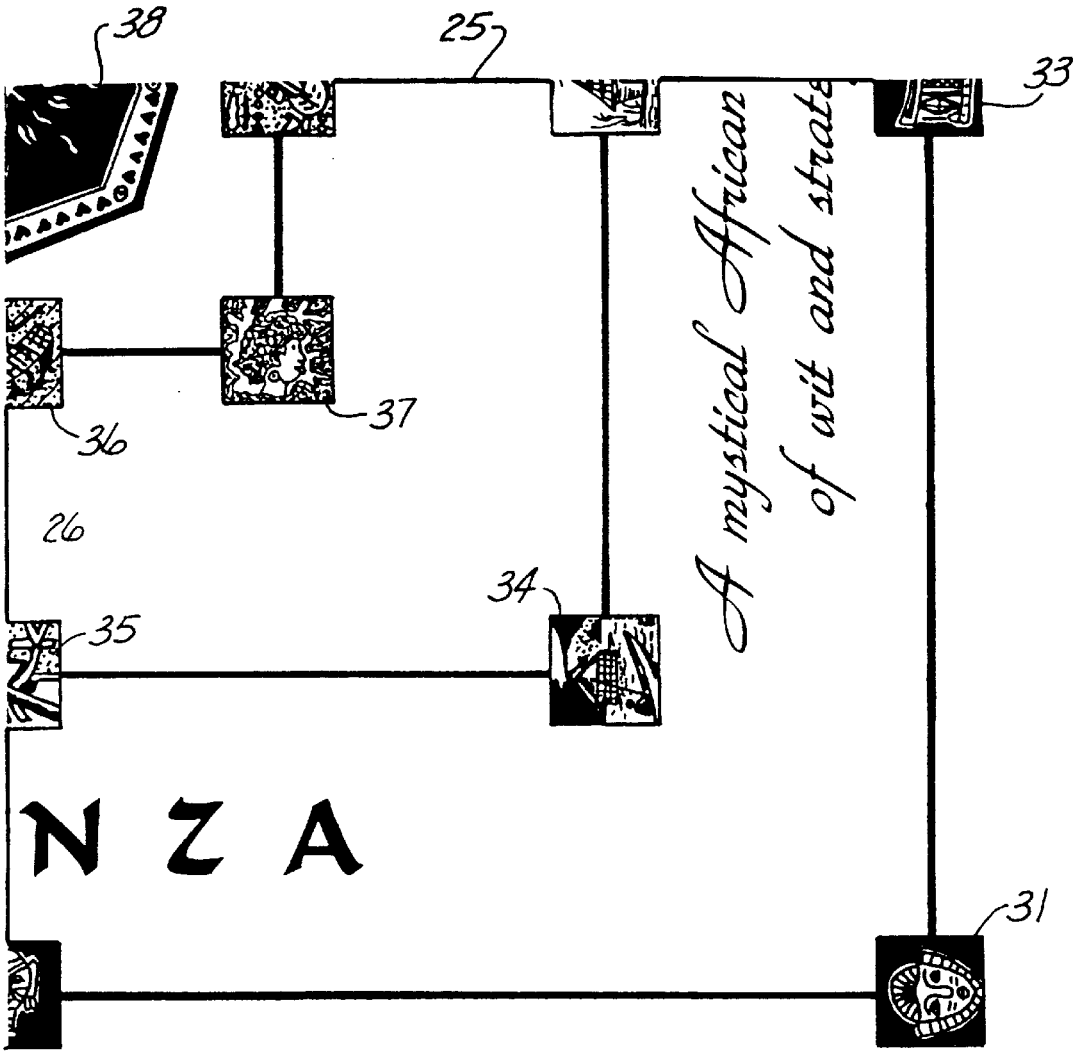

As can best be seen by reference to FIGS. 1 and 3, the game board unit 11 comprises a flat one piece game board member 20 having a generally square configuration. The playing surface of the game board member 20 is provided with an outer game square 21, an inner game square 23, and an intermediate game square 22 which is equally spaced from both the outer 21 and the inner 23 game squares.

In addition, each of the game squares 21, 22, 23, are provided with a plurality of different pictorial squares designed generally as 30 wherein the purpose and function of the pictorial squares 30 will be explained in greater detail further on in the specification.

Still referring to FIGS. 1 and 3, it can be seen that the plurality of pictorial squares 30 are arranged in groups of eight pictorial squares 30 on each of the game squares 21, 22, 23. Each of the corners and the midpoint of each side of each of the game squares 21, 22, 23, are provided with pictorial squares 30.

Furthermore, the pictorial squares 30 on each of the midpoints of the adjacent sides of each of the game squares 21, 22, 23, are provided with connecting lines 24, 25, 26, 27, respectively, whose purpose and function will likewise be explained in greater detail in conjunction with the rules of the game.

Turning now to FIGS. 3A, 3B, 3C and 3D, it can be appreciated that while each of the pictorial squares 30 are different from one another in their pictorial representation, there are groups of pictorial squares 30 that are related to one another on each of the game squares 21, 22, 23, and there are related themes depicted by the pictorial squares 30 on each game square, such as 21 which are different from the themes depicted on the other game squares 22 and 23.

In the preferred embodiment of the invention depicted in the drawings on the outer game square 21, one group of related pictorial squares 31 depicts African masks, another group of related pictorial squares 32 depicts African wildlife, and yet another group of related pictorial squares 33 depicts religious symbols whereby the overall theme of the outer square represents mysticism, spiritualism and animist beliefs.

Turning now to the intermediate game square 22, it can be seen that one group of pictorial squares 34 depicts African landscapes and another group of pictorial squares 35 represents daily life scenes in a traditional African village wherein the overall theme of the intermediate game square 22 represents the traditional African environment.

Furthermore, the inner game square 23 has one group of pictorial squares 36 that represent musical instruments and another group of pictorial squares 37 that represent musicians, entertainers, and storytellers. the overall theme of the inner game squares represents the myriad social aspects of the African culture.

In addition, as can best be seen by reference to FIGS. 1 and 3, the center of the game board 20 is provided with an abstract central symbol 38 which is intended to represent the complexity of African life in general. The players of the game must acquire an awareness and understanding of all of the aspects of African life represented in the pictorial squares 30 taken in harmony with one another in order to gain an appreciation of the overall significance of the central symbol 38.

Figure 2:
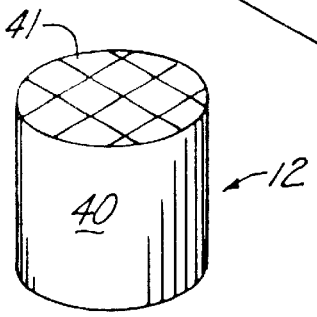
FIG. 2 is an isolated perspective view of one of the game pieces.

Turning now to FIGS. 1 and 2, it can be seen that the game piece units 12 each comprise a generally cylindrical game piece member 40 having a pattern designated generally as 41 imprinted on the top surface thereof. Each player is provided with ten game piece members 40 having a different color and pattern 41 than the color and pattern of his opponent's game piece members 40.

In addition, as suggested by the phantom lines appearing in FIG. 1, each of the game piece members 40 are dimensioned to substantially overlie each of the pictorial squares 30 on the game board 20 and the rules of the game will now be described in detail.

To begin with, the game is played by two opposing sides of one or more players wherein each side begins the game with ten game piece members having a chosen color and pattern. Each side then takes turns placing their respective game piece members one at a time in a sequential fashion on selected pictorial squares 30.

During this initial placement of playing piece members 40, neither of the sides is allowed to have three of their game piece members on three adjacent pictorial squares aligned along either a common vertical or horizontal line. However, each side should position their game pieces such that after the initial placement has been concluded, they can align three of their own game pieces in a straight line quickly while also preventing the other side from accomplishing the same objective.

Again, once the initial game piece member placement has occurred, each side takes turns moving one of their game piece members 40 and this movement can only occur onto an adjacent empty pictorial square 30. If this movement of a game piece member results in three similar game piece members being disposed in a straight line of adjacent pictorial squares, the successful side can then remove any one of the opposing side's game piece members from the game board for the duration of the game. Thus, as each side scores, the number of game piece members on the game board 20 decreases while the number of pictorial squares available to be occupied by a game piece member increases.

It should further be noted that as the game progresses, different pictorial squares will become covered and uncovered with the number of uncovered squares increasing as the game progresses and the visual images and themes depicted on the squares will have an impact on the players of both sides on both a conscious and subconscious level that will undoubtedly enhance their collective appreciation of their ancestral African traditions and culture.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A board game for both strategy and the familiarization and education of the players with respect to typical African culture and tradition; wherein the board game comprises:

a game board unit including a game board member having an outer game square, an inner game square and an intermediate game square; wherein, the midpoints of each of the adjacent sides of each of the game squares are provided with connecting lines;

a plurality of groups of pictorial squares disposed on each of the inner, outer, and intermediate game squares wherein each of the group of pictorial squares depict different aspects of African tradition and culture including the themes of religion, the African environment and the African social culture, respectively; and a plurality of game piece members divided into two numerically equal groups of game piece members; wherein, said plurality of game piece members is less than said plurality of pictorial squares.

2. The board game as in claim 1 wherein each of said game squares is provided with an equal number of pictorial squares.

3. The board game as in claim 2 wherein the corners and the midpoints of each of the sides of each of the game squares are provided with pictorial squares.

4. The board game as in claim 3 wherein said equal number of pictorial squares on each of said game squares are arranged into groups of related pictorial squares.

5. The board game as in claim 1 wherein said remaining game square has one group of related pictorial squares representative of musical instruments and another group of pictorial squares representative of musicians, entertainers, and storytellers.

6. The board game as in claim 1 wherein each of said game piece members are dimensioned to substantially cover each of the pictorial squares.

7. The board game as in claim 1 wherein each of said themes are associated with one of said inner, outer, and intermediate game squares.

8. The board game as in claim 4 wherein each of said themes are associated with one of said inner, outer, and intermediate game squares.

9. The board game as in claim 8 wherein one of the game squares has one group of related pictorial squares representative of African masks, another group of related pictorial squares representative of African wildlife, and yet another group of related pictorial squares representative of religious symbols.

10. The board game as in claim 9 wherein another of the game squares has one group of related pictorial squares representative of African landscapes and another group of pictorial squares representative of daily life scenes in a traditional African village.

11. The board game as in claim 10 wherein yet another game square has one group of related pictorial squares representative of musical instruments and another group of pictorial squares representative of musicians, entertainers, and storytellers.

* * * * *